United States Patent [19]

Petry

[11] 4,226,198

[45] Oct. 7, 1980

[54] DEVICE FOR THE CONTOUR SEWING OF WORKPIECES

[75] Inventor: Kurt Petry, Stelzenberg, Fed. Rep. of Germany

[73] Assignee: Pfaff Industriemaschinen GmbH, Fed. Rep. of Germany

[21] Appl. No.: 73,111

[22] Filed: Sep. 6, 1979

[30] Foreign Application Priority Data

Oct. 2, 1978 [DE] Fed. Rep. of Germany ..... 2842993

[51] Int. Cl.[2] ..... D05B 21/00; D05B 23/00; D05B 33/00; D05B 27/00

[52] U.S. Cl. ..... 112/121.12; 112/121.27; 112/121.29; 112/309

[58] Field of Search ..... 112/121.12, 121.11, 112/121.15, 121.27, 121.29, 2, 153, 309

[56] References Cited

U.S. PATENT DOCUMENTS

| | | | |
|---|---|---|---|
| 2,971,483 | 2/1961 | Cordier | 112/309 |
| 3,633,526 | 1/1972 | Fay | 112/121.29 |
| 3,785,307 | 1/1974 | Hunter, Jr. et al. | 112/121.27 |
| 3,970,017 | 7/1976 | Babson et al. | 112/309 X |
| 4,117,790 | 10/1978 | Hasegawa et al. | 112/309 |

*Primary Examiner*—H. Hampton Hunter
*Attorney, Agent, or Firm*—McGlew and Tuttle

[57] ABSTRACT

A device for use with a motor driven sewing machine having a reciprocating needle which in moving from an upper position to a down position penetrates a workpiece which is fed over a support past and in contact with a guide edge disposed alongside the needle in order to form a plurality of different seam lengths at diverse angles comprises a stacking device adjacent the support which includes a mechanism for feeding the workpieces into a stack. A turning device is associated with the sewing machine and is disposed alongside the support and includes a member which moves through a path to engage the workpiece and turn it about at the axis of the needle when the needle is down so as to position it in respect to the guide edge for the sewing of the next seam length. A rail switch is disposed between the stacking device and the turning device and includes a first switch position in which a path is defined between the support and the stacking device for feeding from the support to the stacking device and a second position in which a path is defined to the turning device for feeding the workpiece into association with the turning device.

6 Claims, 4 Drawing Figures

DEVICE FOR THE CONTOUR SEWING OF WORKPIECES

FIELD AND BACKGROUND OF THE INVENTION

This invention relates in general to sewing machines, and in particular to a new and useful device for selectively positioning a workpiece relative to a sewing machine needle and for turning the workpiece about selective angles in order to sew selective seam lengths at diverse angles and which includes means for selectively passing the workpiece into association with the device for turning it or to move it into a stacking device for stacking.

In sewing machines capable of edge parallel contour sewing the workpieces must be turned for contour sewing, not only after completion of the last seam section, but at the end of each seam section. To facilitate the turning, and to get along with a table top as small as possible, thus saving space, it is known practice to give the table top of the sewing machine a semicicular form at the end adjacent to the stitch forming point. The portion of the workpiece in excess of the size of the diameter can then hand down over the edge of the semicircular part of the table top.

With this device, a stacking device, which greatly contributes to efficient production, can be arranged only at a distance behind the sewing machine which is at least equivalent to the length of one workpiece. This distance must be adapted to the longest workpiece to be sewn and must be bridged by a bearing plate for the workpiece. Adaptation to the longest workpiece, however, has the result that shorter workpieces are not automatically gripped by the transport means of the stacking device, so that an additional transport system must be used. For the installation as a whole the adaptation to the longest workpiece leads to a relatively great overall length, requiring a correspondingly large floor space, which is rarely available in sufficient degree in the production plants.

SUMMARY OF THE INVENTION

The invention provides a sewing machine capable of edge parallel contour so that the stacking device for the material being sewn can be arranged directly behind the sewing machine table and the use of an additional transport system dispersed with.

In accordance with the invention the device for use with a motor driven sewing machine having a reciprocating needle which in moving from an upper to a down position penetrates a workpiece fed over a support past and in contact with a guide edge disposed alongside the needle so as to form a plurality of different seam lengths at diversed angles comprises a stacking device adjacent this too but spaced from the support which has means for feeding the workpieces into a stack. Between the stacking device and the support plate a turning device is operative and a rail switch permits the feeding of the material downwardly from the support into association with the turning device so that the device will turn the workpiece for sewing at selected seam angles. The switch also includes means for delivering the workpiece over the top of the turning device to the stacking device after all of the seams have been sewn for positioning in a stack.

Accordingly, it is an object of the invention to provide an improved device for use with a motor driven sewing machine which has a reciprocating needle which in moving from an upper to a down position penetrates the workpiece fed over a support past and in contact with a guide edge disposed alongside the needle to form a plurality of different seam lengths at diverse angles which comprises a stacking device adjacent the support having means for feeding the workpieces into a stack, turning means associated with the sewing machine and disposed alongside the support including a member movable through a path to engage the workpiece and turn it about the axis of the needle when the needle is down so as to position it in respect to the guide edge for the securing of the next seam length and further including a rail switch disposed between the stacking device and the turning device and the support which permits selective delivery of the workpiece into association with either the turning means or the stacking means.

A further object of the invention is to provide a sewing machine and associated accessories which are simple in design, rugged in construction and economical to manufacture.

The various features of novelty which characterize the invention are pointed out with particularity in the claims annexed to and forming a part of this disclosure. For a better understanding of the invention, its operating advantages and specific objects by its uses,

DESCRIPTION OF THE PREFERRED EMBODIMENTS

Figure 1:
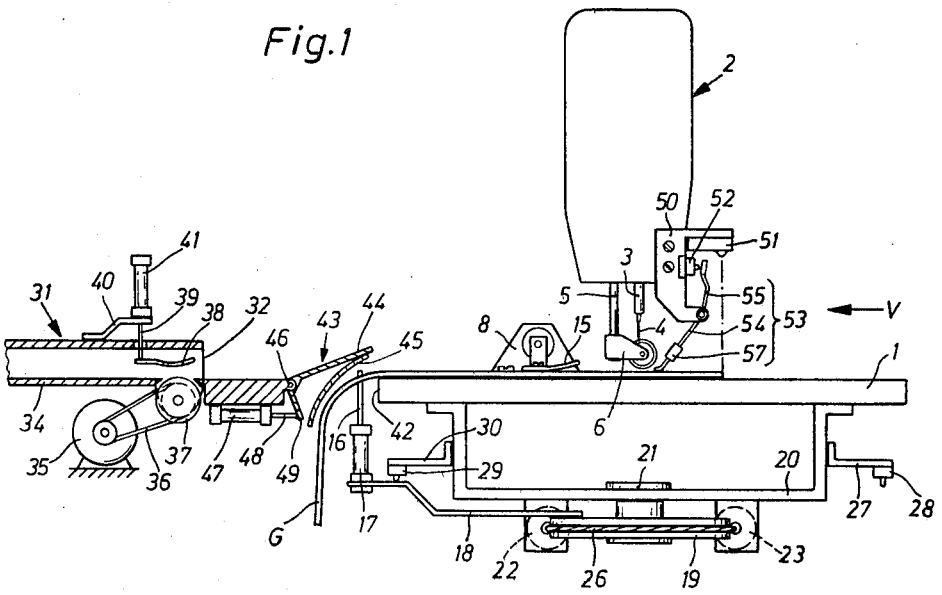
FIG. 1 is a partial sectional and front elevational view of a sewing machine having turning and stacking devices constructed in accordance with the invention.
Figure 2:
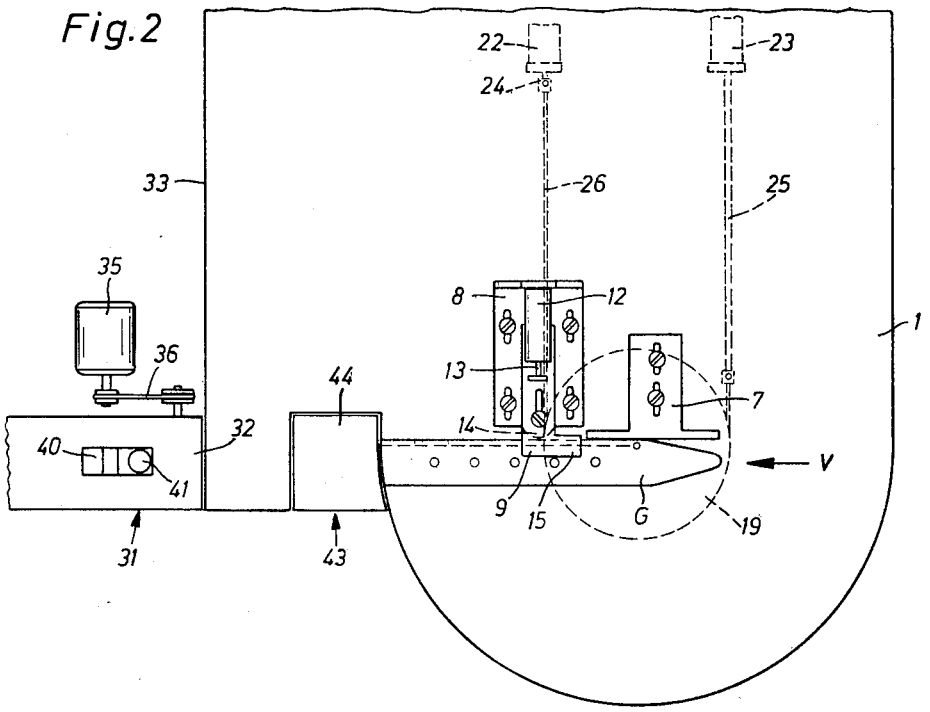
FIG. 2 is top plan view of the device shown in FIG. 1 but without the sewing machine being indicated.

Referring to the drawings, in particular, the invention embodied therein comprises a device for use with a motor driven sewing machine 2 which has a reciprocating needle 4 which moves from an upper to a down position and in so doing penetrates a workpiece G which is fed over a support or table 1 past and in contact with a guide or guide rule 7 which is disposed alongside the needle 4. The device is employed for forming a plurality of different seam lengths at diverse angles to each other and after the seam lengths are formed to feed the workpiece G into association with stacking device 31 for stacking the individual workpieces. The device advantageously includes turning means associated with the sewing machine in operative time relationship to the reciprocation of the needle 4 to engage the workpiece and pivot it about the axis of the needle when the needle is in a down position in which it penetrates the workpiece and the sewing machine is temporarily stopped.

In accordance with a feature of the invention during the sewing of the workpiece G a so called rail switch 43 is set to deliver the workpiece into association with a turning mechanism which includes a member 16 engageable with a side of the workpiece to pivot it about the axis of the needle 4 when it is engaged in the workpiece.

The operative mechanism includes control means for controlling the starting and stopping of the motor driving the sewing machine to affect changes of the workpiece relative to the needle axis for sewing various seam lengths and for shifting the rail switch 43 so that the workpieces are delivered after they have been finished into association with the stacking device 31.

In a cutout of the table top 1 of the machine frame not shown in detail, a sewing machine 2 is installed, which is driven by an electric motor in the usual manner. The end of the table top 1, situated in the region of the head of the sewing machine 2, is designed in semicircular form around a needle 4. The needle bar 3, movable up and down in the head of the sewing machine 2, carries at the lower end the needle 4, which cooperates for seam formation with a looper not shown. On the presser bar 5, raisable against spring action, a roller foot 6 is fastened to press the work against the usual feed plate of the sewing machine, carrying out a quadrangular movement. To guide the work, an edge guide rule 7 is provided which is adjustable crosswise to the feed direction shown by the arrow V, and it is secured on the work support plate of the sewing machine 2.

At a distance behind the edge guide rule 7, a slide 9 is mounted on a base plate 8 which is secured in a selected position on the work support plate of the sewing machine, by means of trunnion screws 11. The slide 9 is mounted for displacement crosswise to the feed direction shown by the arrow V, and it can be driven by a single-action compressed air cylinder 12 secured to the base plate 8, the piston rod 13 of which is connected with slide 9 and is under the action of a return spring (not shown) disposed in the interior of the compressed air cylinder. Slide 9 comprises an arcuate guide edge 14, formed on the slide under a projection 15 serving as work holddown. The purpose of slide 9 is to bring the workpiece G into a position oriented for the next seam section by relatively small angles.

To turn the workpiece G by much greater angles, a work gripper is provided which is formed by the piston rod 16 of a compressed air cylinder 17 arranged perpendicular to the work bearing surface at the free end of a support 18. The support 18 is secured on a pulley 19 mounted under the table top 1 on a gudgeon 21 secured in a strut 20. The longitudinal axis of gudgeon 21 coincides with the longitudinal axis of the needle 4. The pulley 19 and hence the support 18 with the work gripper 16/17 are driven in rotation by two compressed air cylinders 22,23 arranged under the table top 1 and each has a piston rod 24, 25 therein connected to a respective end of a rope or cable 26 which is passed over pulley 19. Upon rotation of pulley 19 with the support 18, the piston rod 16 of cylinder 17 is moved parallel to the outer edge of the semicircular end of the table top 1. The rotary movement of pulley 19 and hence of support 18 with the work gripper 16/17 is limited in one direction by a limit switch 28, disposed on a bracket 27 secured on strut 20, and is limited in the other direction of rotation by a limit switch 29 also disposed on a bracket 30 secured on the strut 20.

On the work discharge side, the table top 1 is widened somewhat in continuation of the semicircular end, to create a guide path for the work to a stacking device 31, whose inlet chute 32 is directly contiguous to the rear edge 33 of the table top 1. The stacking device 31 is of known design. Its inlet chute 32 has a bottom 34 which can be pulled away crosswise to the work feed direction, arrow V. There protrudes into a cutout in the bottom 34 the upper end of a transport roll 37 which is driven by a motor 35 through a V-belt 36 and whose circumferential speed is greater than the maximum work feed speed. Cooperating with the transport roll 37 is a holddown 38 disposed on the piston rod 39 of a compressed air cylinder 41 secured to a bracket 40 at the inlet chute. The piston rod 39 is biased by a return spring (not shown) inside the cylinder.

In the guide path between the stitch forming point and the stacking device 31, in a cutout 42 in the enlargement of the table top 1, a (rail) switch 43 is arranged which consists of a cover plate 44 of L-shaped cross-section with an arcuate guide plate 45 fastened to its underside and extending into the cutout 42, and which is pivotably mounted near the rear edge of the cutout 42 by means of a hinge pin 46. The front edge of cover plate 44 is adapted to the form of the semicircular part of the table top 1 and is directly contiguous to the work discharge edge of the semicircular part.

To actuate switch 43 a compressed air cylinder 47 is provided, whose piston rod 48 engages at the downwardly extending leg 49 of cover plate 44 and which is secured to the underside of the table top.

Control means for the sewing machine 2 and for the turning device, switching as a function of the work, are arranged on a support 50 secured to the head side of the sewing machine 2. The control means include a photoelectric pulse switch 51 and an electric microswitch 52. The purpose of the pulse switch 51 is to shift the drive motor of the sewing machine to a lower speed when certain seam points are reached and to switch on the actuating cylinder 12 of slide 9 of the turning device.

Associated with switch 52 is a work sensor 53, comprising a lever having a feeler arm 54 and a switching arm 55. The feeler arm 54 is pivotably mounted by its horizontal part in a bushing 56 in support 50. On the free end of the horizontal part of feeler arm 54 the switching arm 55 is attached and secured by screwing. Feeler arm 54 is provided at the lower end with a weight 57, and during sewing its free end rests on the workpiece G by gravity, while the enlarged free end of the switching arm 55 actuates switch 52 when no workpiece is under the feeler arm 54. In this case the sewing machine is stopped at point C, FIG. 4, in the low position of the needle, and the work gripper 16/17 of the turning device is switched on to turn the workpiece G so that its edge makes contact with the edge guide 7 between C and D. The end positions of the work gripper 16/17 of the turning device are fixed by the switches 28 and 29.

Figure 3:
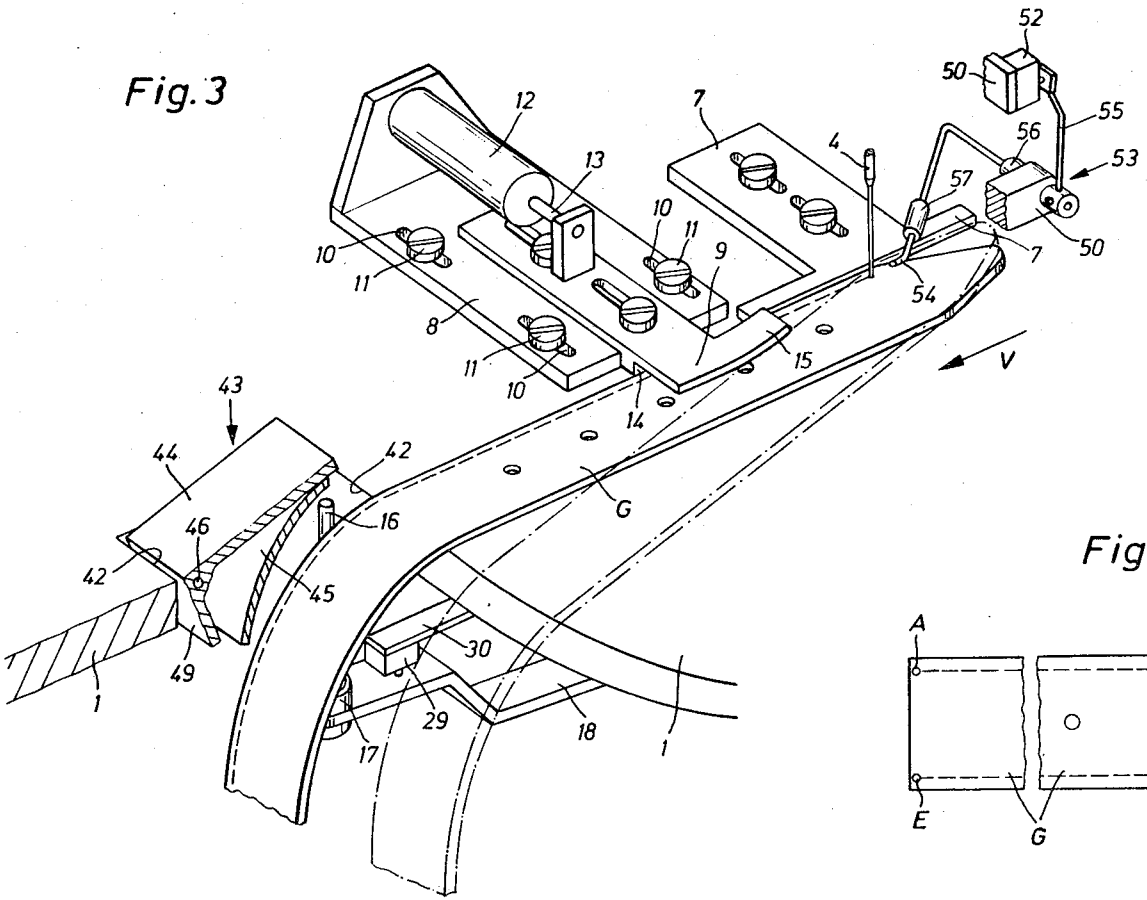
FIG. 3 is an enlarged perspective view of a portion of the mechanism shown in FIGS. 1 and 2.

The mode of operation of the device is explained below with reference to the example of a belt with pointed tongue to be contour sewn:

In the starting position, the sewing machine 2 is stopped with the needle in up position, the roller foot 6 is raised, the slide 9 is in its position shown in solid lines in FIG. 3, the switch 43 is lowered, so that the cutout 42 in the table top 1 is covered by the cover plate 44, the work gripper 16/17 arranged on the support 18 occupies its starting position shown in the drawing, the holddown 38 is raised, and the motor 35 of the transport roll 37 of the stacking device is switched on.

Figure 4:
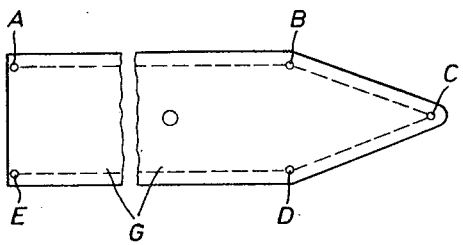
FIG. 4 is a partial top plan view of the workpiece showing the seam areas to be sewn thereon.

Starting from this position, a belt G is fed to the sewing machine in such a way that point A, FIG. 4 is under the needle 4 and the lateral edge of belt G rests against the edge guide 7 between points A and B. The roller foot 6 having been lowered onto belt G, the sewing machine 2 is then switched on by operating a start switch and at the same time the compressed air supply to the compressed air cylinder 47 is turned on, so that switch 43 is pivoted up by the piston rod 48. The seam length A-B is then sewn in rapid motion, constant contact of the lateral edge of the belt against the edge guide; 7 being accomplished by means not shown - for example two feed plates which execute feed movements of different lengths. As the seam length A-B is being sewn, the workpiece runs into the cutout 42 and is steered downward into the movement path of the piston rod 16 of the turning device by the guide plate 45.

If the light beam emitted by the light source of the pulse switch 51 is reflected by the switch-plate being bared, the sewing machine 2 is shifted to a lower speed and the compressed air cylinder 12 is switched on, whose piston rod 13 displaces the slide 9 crosswise to the feed direction, arrow V, thereby turning the belt G in such a way that the edge section between points B and C makes contact on the edge guide 7. This position of belt G is indicated in dash-dot lines in FIG. 3.

The seam section B-C is then sewn at a reduced machine speed. After the tip of the tongue of belt G has passed the feeler arm 54, and sensor 53 responds, and its switching arm 55 actuates switch 52, whereby the sewing machine is stopped with needle 4 in down position at point C, FIG. 4, and the roller foot 6 is raised. Immediately thereafter the compressed air cylinders 17 and 23 are pressurized, so that the piston rod 16 acting as work gripper is extended and the pulley 19 with the support 18 and the compressed air cylinder 17 is rotated about the gudgeon 21 through the cable 26 connected with the piston rod 25 of cylinder 23 and thereby the cylinders 12,17, 23 and 27 are vented and with some delay cylinder 22 is pressurized. During the described turning movement, belt B is taken along by the piston rod 16 of cylinder 17 and is turned around the needle 4 until the edge between C and D applies against the edge guide 7. The belt length between point D and the point of engagement of the gripper 16 is brought into the position oriented for the sewing of the seam length D-E by the gripper 16 already with the lateral edge between D and E, the belt being able to arch upward for length compensation.

While rotation around the needle takes place, sensor 53 is raised by belt G and switching arm 55 releases the prong of switch 52, owing to which switch 52 assumes a different position, in which the roller foot 6 is lowered and the sewing machine 2 is switched on for sewing the seam lengths C-D and D-E.

Due to the interruption of the compressed air supply to the cylinders 12,17,23 and 47 and the pressurization of cylinder 22, the piston rod 13 and hence the slide 9 is retracted by the return spring of cylinder 12 into the starting position, piston rod 16 of cylinder 17 serving as work gripper is lowered by the return spring thereof, pulley 19 with the support 20 and cylinder 17 is rotated back into the starting position, in which the support 18 actuates switch 29 to interrupt the compressed air supply to cylinder 22, and (rail) switch 43 pivots down under its own weight, so that the cover plate 44 closes the cutout 42 in the table top 1. Belt G is guided over the cutout 42 covered by the cover plate 44 into the inlet chute 32 of the stacking device, where, by the holddown 38—which may be controlled for example by a sensor switch of its own—it is pressed against the revolving transport 37, by which, after the sewing machine has been stopped with the needle in up position and the threads have been cut off in known manner, it is conveyed completely into the inlet chute 32, whence it falls onto a stack after the bottom 34 has been pulled away.

It is evident that all the operator has to do is to insert the workpieces and to switch on the machine drive. The other described processes occur automatically. During the relatively long sewing time, therefore, the tending of other machines is possible. The device can be converted for the contour sewing of belts of other tongue forms without any great expense.

While specific embodiments of the invention have been shown and described in detail to illustrate the application of the principles of the invention it will be understood that the invention may be embodied otherwise without departing from such principles.

What is claimed is:

1. A device for use with a motor driven sewing machine having a reciprocating needle which in moving from an upper to a down position penetrates a workpiece which is fed over a support past and in contact with a guide edge disposed alongside the neelde to form a plurality of different seam lengths at diverse angles to each other, comprising a stacking device adjacent the support having means for feeding the workpieces into a stack, turning means associated with said sewing machine and disposed alongside said support including a member movable through a path to engage the workpiece and turn it about the axis of the needle when the needle is in a down position engaged in the workpiece so as to position the workpiece in respect to the guide edge for sewing of the next seam length, and a rail switch disposed between said stacking device and said turning means and said support having a first switch position defining a path over which the material is fed to said stacking device and a second switch position defining a path over which said material is delivered to said turning means and means connected to said rail switch and said end of sewing machine for changing the rail switch position.

2. A device according to claim 1 wherein said rail switch includes a cover plate having a top surface over which the material is fed to said stacking device and a guide plate extending downwardly at an angle from the cover plate defining a deflecting means for deflecting the material into association with said turning means, said support comprising a table having a rounded portion substantially concentric to the sewing machine and an extended side portion on one side of said rounded portion with a cutout area which is filled by said cover plate.

3. A device according to claim 2 wherein said sewing machine support includes a semicircular formed sewing machine table top and said rail switch having a top plate which is contiguous to the semicircular table top disposed between the semicircular table top and a rectangular portion of said support.

4. A device according to claim 3 wherein said turning means comprises a slide spaced from said needle and movable crosswise to the workpiece feed direction for turning the workpiece by relatively small angles, a gripper member rotatable about the longitudinal axis of said needle for turning about much greater angles.

5. A device according to claim 4 wherein said workpiece gripping member comprises a piston rod of a fluid pressure operated piston and cylinder combination, a support arm pivotably mounted below said support table and carrying said fluid pressure operated piston and cylinder combination, said support plate being rotatable about the longitudinal axis of the needle.

6. A sewing device comprising a support table having a semicircular portion with at least one side having a laterally extending edge portion forming a rectangular area with a cutout area therein, a stacking device located alongside the outwardly extending rectangular portion and including a rotatable member engageable with a workpiece for moving along a feed path, a switch member disposed in the cutout portion and including a top plate over which the workpieces are fed from said support table to said stacking device in an oblique deflection plate below said top plate disposed below the top of said support table, means for shifting said switch to position said deflecting device above the top of said support table so as to deflect the workpieces down between said switch and said support table, a turning device including a member rotatable through a path in the cutout portion which is engageable with a workpiece to pivot the workpiece, a guide on said semicircular portion of said guide table alongside which a workpiece is fed, said sewing machine including a needle reciprocating on said guide table in the center of said semicircular portion of said workpiece, the workpiece being movable past said needle and being deflectable by said turning member so as to vary the angle of the workpiece relative to the needle to vary the position of the seam being sewn by said needle.

* * * * *